US008608165B2

(12) United States Patent
Nakagaki

(10) Patent No.: US 8,608,165 B2
(45) Date of Patent: Dec. 17, 2013

(54) SHEET CONVEYANCE DEVICE AND IMAGE FORMING APPARATUS WITH CONVEYANCE GUIDE FOR CONVEYANCE BELT

(75) Inventor: Toshihiro Nakagaki, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/239,536

(22) Filed: Sep. 22, 2011

(65) Prior Publication Data

US 2012/0074638 A1 Mar. 29, 2012

(30) Foreign Application Priority Data

Sep. 28, 2010 (JP) ..... 2010-217976

(51) Int. Cl.
*B65H 5/02* (2006.01)

(52) U.S. Cl.
USPC ..... 271/275; 271/186; 271/198; 271/225

(58) Field of Classification Search
USPC ..... 271/186, 198, 225, 275
See application file for complete search history.

(56) References Cited

U.S. PATENT DOCUMENTS 3,729,188 A * 4/1973 Stephenson ..... 271/186
4,179,215 A * 12/1979 Hage ..... 271/4.05
4,264,187 A * 4/1981 Rhodes, Jr ..... 271/275
4,846,456 A * 7/1989 Sakai ..... 271/3.05

FOREIGN PATENT DOCUMENTS

JP 2010-24029 2/2010

* cited by examiner

*Primary Examiner* — Gerald McClain
(74) *Attorney, Agent, or Firm* — Oblon, Spivak, McClelland, Maier & Neustadt, L.L.P.

(57) ABSTRACT

A sheet conveyance device includes an upstream rotary member and a downstream rotary member, an endless rotatable conveyance belt, stretched over the upstream rotary member and the downstream rotary member, to convey a sheet of recording media thereon in a predetermined conveyance direction, a conveyance guide disposed downstream of the conveyance belt in the predetermined conveyance direction, disposed across a gap from the conveyance belt, to guide the sheet to a predetermined conveyance position, and a guide member to introduce the sheet into a gap between the conveyance belt and the conveyance guide and onto the conveyance belt, so that the sheet is conveyed from the downstream rotary member to the upstream rotary member.

7 Claims, 5 Drawing Sheets

SHEET CONVEYANCE DEVICE AND IMAGE FORMING APPARATUS WITH CONVEYANCE GUIDE FOR CONVEYANCE BELT

CROSS-REFERENCE TO RELATED APPLICATIONS

The present application claims priority from Japanese patent application number 2010-217976, filed on Sep. 28, 2010, the entire contents of which are incorporated by reference herein.

FIELD OF THE INVENTION

The present invention relates to a sheet conveyance device and an image forming apparatus including the sheet conveyance device, and in particular relates to a sheet conveyance device including a conveyance belt to convey a sheet while contacting a driving roller to be driven in a predetermined direction and a guide plate to guide the sheet disposed downstream of the conveyance belt driving direction and spaced away from the belt.

DESCRIPTION OF THE RELATED ART

Generally, in image forming apparatuses, a recording sheet such as a sheet of paper is conveyed from one predetermined place to another by a sheet conveyance device. Such a sheet conveyance device includes an internal conveyance path defined by a plurality of guide plates and a plurality of rollers or a belt which are rotatably driven to convey the sheet.

FIG. 6 is a cross-sectional view of a known image forming apparatus including such a sheet conveyance device. In addition, FIG. 4 is a cross-sectional view of a conventional sheet conveyance device illustrating a general structure thereof. FIG. 5 is an oblique perspective view illustrating a main part of the device in FIG. 4.

An image forming apparatus 100 includes a sheet conveyance section 180 which includes a sheet feed bank 110, a registration unit 120, and a duplex-sheet discharge unit 130. The duplex sheet-discharge unit 130 includes a fixing unit 140 and a sheet conveyance device 150.

The image forming apparatus 100 includes an intermediate transfer device 160 which includes image carriers of yellow, magenta, cyan, and black 170Y, 170M, 170C, and 170Bk, respectively, and an intermediate transfer belt 161.

A toner image formed by the image carriers 170Y, 170M, 170C, and 170Bk is transferred to the intermediate transfer belt 161. A sheet S fed from the sheet feed bank 110 is conveyed to the intermediate transfer device 160, and the toner image on the intermediate transfer belt 161 is transferred onto the sheet S. The toner image on the sheet S is fixed by the fixing unit 140 and the sheet S is discharged by the sheet conveyance device 150.

The sheet conveyance device 150 includes a driving roller 210, a driven roller 220, and a conveyance belt 230 stretched over the driving roller 210 and the driven roller 220. The conveyance belt 230 is a wide single conveyance belt. The conveyance belt 230 includes a cooling roller 240 to contact and cool the sheet S being conveyed, and contact rollers 250, 260 positioned opposite the driving roller 210 and the driven roller 220, respectively. As illustrated in FIG. 4, the sheet S is conveyed from a guide plate 270 positioned upstream in the sheet conveyance direction to a guide plate 290 downstream and further is conveyed to a conveyance path S1.

In such a sheet conveyance device 150, the driven roller 220 and the conveyance belt 230 stretched over the surface of the driven roller 220 are rotatably driven, so that the driven roller 220 and a lower guide plate 292 are not in contact with each other, that is, a slight gap D is present between the driven roller 220 and the lower guide plate 292. Therefore, when the leading edge of the sheet S has a downward curl, the sheet S may be introduced into the gap D between the driven roller 220 and the lower guide plate 292. In this case, the sheet S does not reach a downstream sheet sensor 460, and therefore, the sheet sensor 460 determines that a paper jam has occurred.

In such a case, if the trailing edge of the sheet S stops before the gap D, the upper guide plate 291 is moved out of the way to allow the sheet S to be pulled out by the leading edge thereof, thereby removing the sheet S. By contrast, if the trailing edge of the sheet S passes completely through the gap D, the sheet S has been already introduced into the depths of the device (indicated by arrow S2 in the figure) and it is not easy to remove the sheet S. To remove the sheet S, disassembly of the device, such as removal of the guide plate and/or the conveyance roller, is needed, which is troublesome.

In addition, even if the trailing edge of the sheet stops before the gap D, erroneous turning of a knob 221 illustrated in FIG. 5 in the sheet conveyance direction causes the sheet to enter further into the device (arrow) similar to the case described above.

To prevent such a sheet jam, JP-2010-024029-A discloses a configuration in which a stopper member stretched over the driven roller and the guide member is provided between the driven roller and the guide plate disposed downstream of the sheet conveyance direction to prevent the conveyed sheet from entering into a gap between the driven roller and the guide plate. In this arrangement, however, the conveyance belt needs to be divided into plural parts laterally, in order to accommodate the stopper, which is physically impossible to do if the conveyance belt is wide one.

In addition, if the conveyance belt is divided into plural parts, the sheet conveyed by the conveyance belt and the cooling roller inevitably loses the desired uniform contact with the belt in some parts. In this case, a pressure difference arises between one part closely contacting the sheet and another contacting the sheet loosely or not at all, which may cause uneven glossiness in the final printed image.

As described above, because the conventional sheet conveyance device includes a gap between the conveyance roller and the guide plate, if a paper jam occurs, the sheet enters the gap. In such a case, it is not easy to remove the jammed paper and disassembly of the guide plate and the conveyance roller is required to remove the sheet, which may take a lot of time and trouble.

BRIEF SUMMARY OF THE INVENTION

The present invention aims to solve the aforementioned problems, and provides an improved sheet conveyance device for use in the image forming apparatus, allowing easy removal of a jammed sheet stuck in a gap between a conveyance roller and the guide plate.

As an aspect of the present invention, a sheet conveyance device according to the present invention includes an upstream rotary member and a downstream rotary member; an endless rotatable conveyance belt, stretched over the upstream rotary member and the downstream rotary member, to convey a sheet of recording media thereon in a predetermined conveyance direction; a conveyance guide disposed downstream of the conveyance belt in the predetermined conveyance direction, disposed across a gap from the conveyance belt, to guide the sheet to a predetermined conveyance position; and a planar guide member to introduce the sheet into the gap between the conveyance belt and the conveyance guide and onto the conveyance belt, so that the sheet is conveyed from the downstream rotary member to the upstream rotary member.

These and other objects, features, and advantages of the present invention will become apparent upon consideration of the following description of the preferred embodiments of the present invention when taken in conjunction with the accompanying drawings.

DETAILED DESCRIPTION OF THE INVENTION

Figure 1:
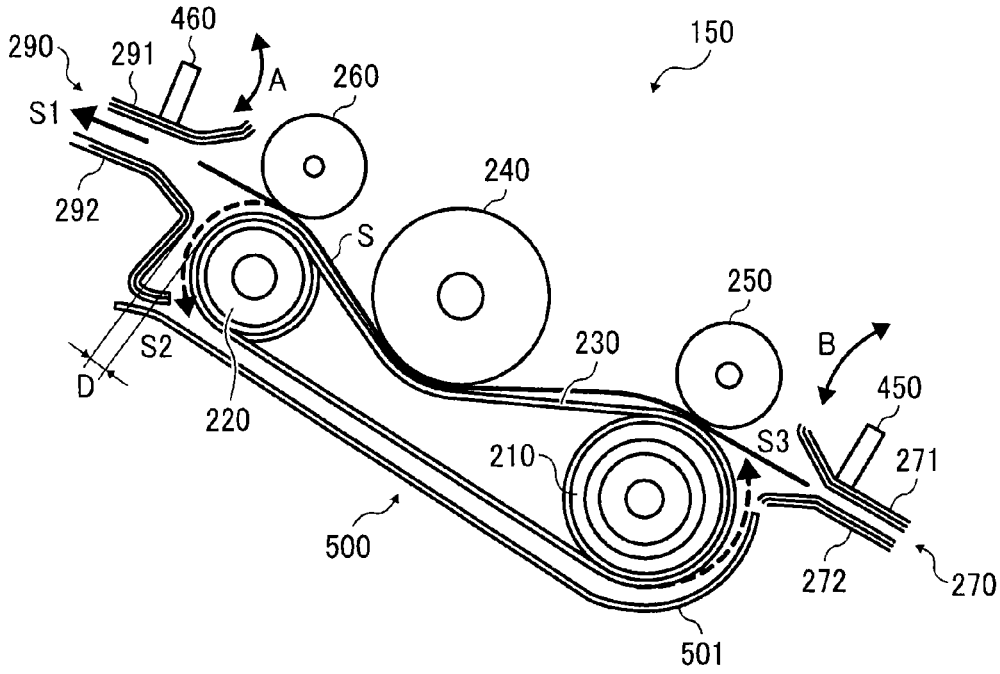
FIG. 1 is a cross-sectional view illustrating a general configuration of a sheet conveyance device according to an embodiment of the present invention.
Figure 2:
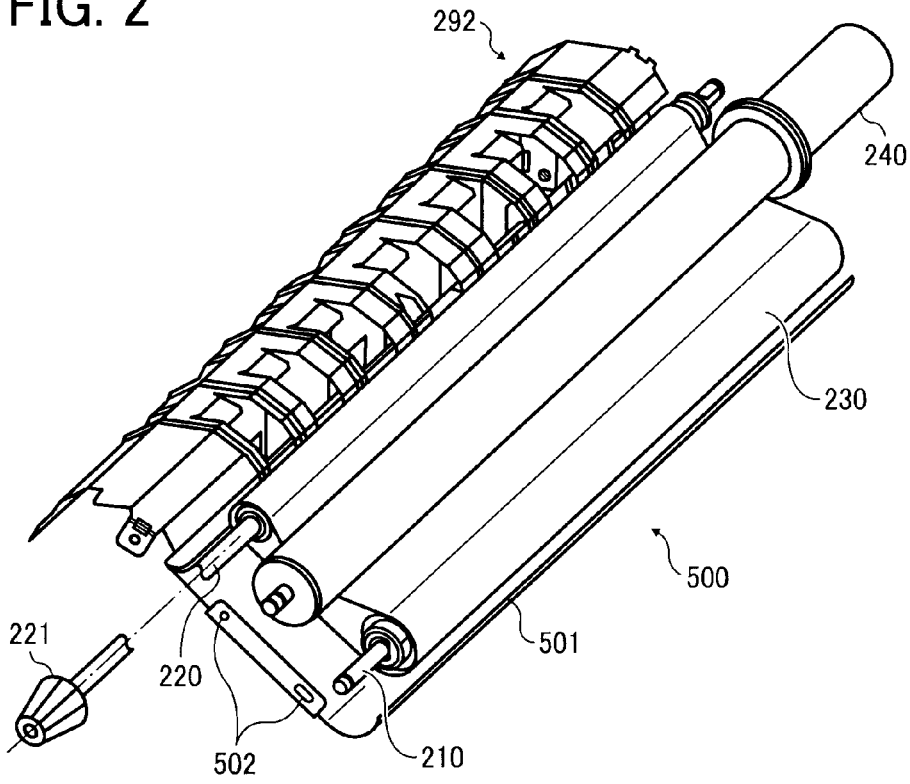
FIG. 2 is an oblique perspective view illustrating a main part of the sheet conveyance device according to an embodiment of the present invention.

Preferred embodiments of the present invention will now be described with reference to the accompanying drawings. FIG. 1 is a cross-sectional view illustrating a general configuration of a sheet conveyance device according to an embodiment of the present invention and FIG. 2 is an oblique perspective view illustrating a main part of the sheet conveyance device of FIG. 1

As illustrated in FIG. 1, the sheet conveyance device 150 is configured to convey a recording medium or a sheet S fed from a guide plate 270 disposed upstream in the sheet conveyance direction to a guide plate 290 downstream in the sheet conveyance direction. The sheet conveyance device 150 further includes a driving roller 210, a driven roller 220, and a conveyance belt 230 stretched over the driving roller 210 and the driven roller 220. The conveyance belt 230 has a wide breadth in the direction perpendicular to the sheet conveyance direction to thus eliminate differences in pressure arising when the belt is divided into several parts and to prevent uneven glossiness in the printed image.

In the present embodiment, the upstream guide plate 270 includes an upper guide plate 271 and a lower guide plate 272. The upper guide plate 271 is configured to be openable in an arrow B direction as illustrated in FIG. 1. Similarly, the downstream guide plate 290 includes an upper guide plate 291 and a lower guide plate 292, and the upper guide plate 291 is openable in an arrow A direction as illustrated in FIG. 1.

The conveyance belt 230 includes a cooling roller 240 to contact and cool down the sheet P which is being conveyed, and rollers 250 and 260 to contact the conveyance belt 230 disposed opposite the driving roller 210 and the driven roller 220, respectively. In this case, a slight gap D is present between the driven roller 220 and the lower guide plate 292. A guide plate 500 is disposed at a lower side of the conveyance belt 230 which forms a conveyance path to guide the sheet S entering from the gap D to an inlet of the sheet conveyance device 150.

Figure 3:
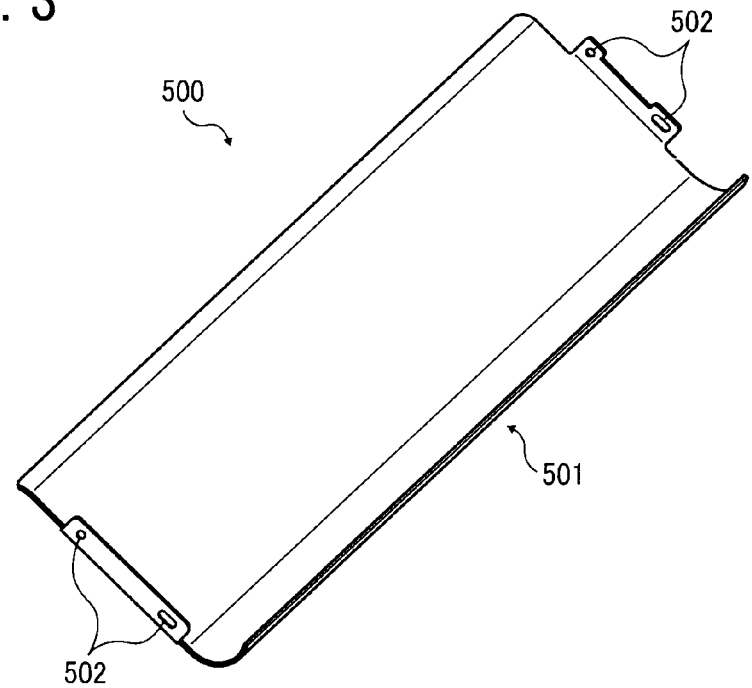
FIG. 3 is an oblique perspective view of a guide member according to an embodiment of the present invention.
Figure 4:
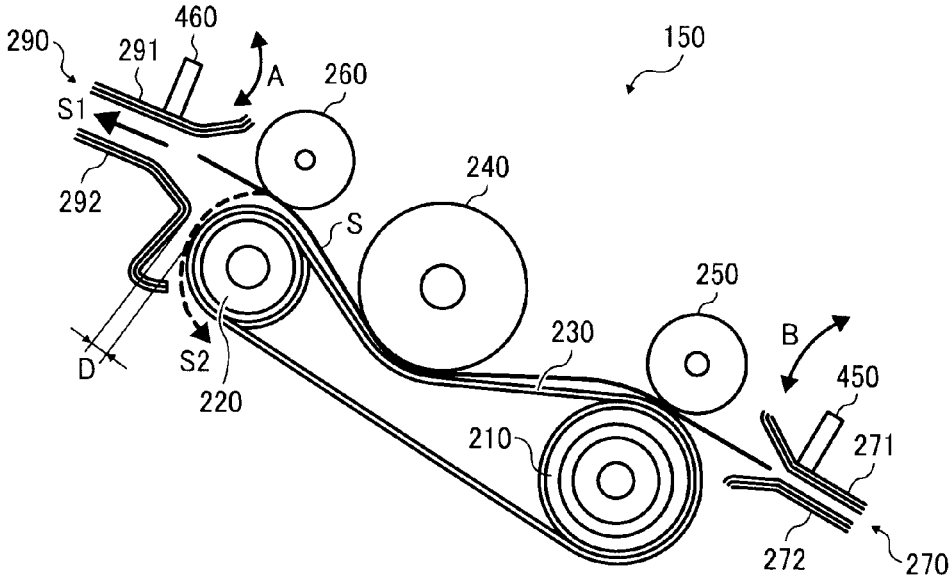
FIG. 4 PRIOR ART
FIG. 4 is a cross-sectional view illustrating a general configuration of a conventional sheet conveyance device.
Figure 5:
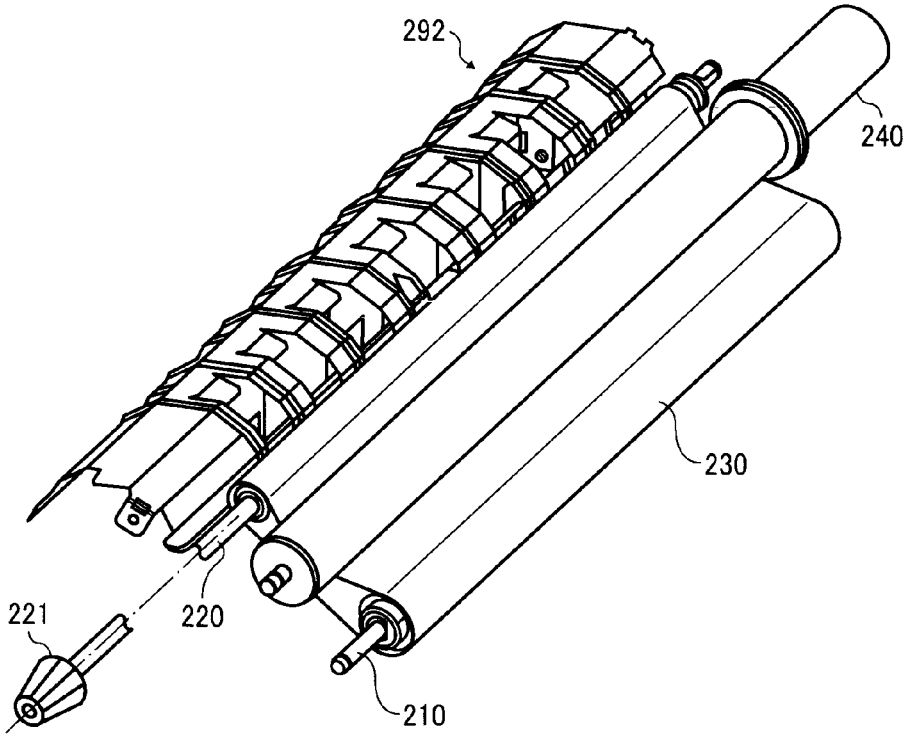
FIG. 5 PRIOR ART
FIG. 5 is an oblique perspective view illustrating a main part of the conventional sheet conveyance device in FIG. 4.
Figure 6:
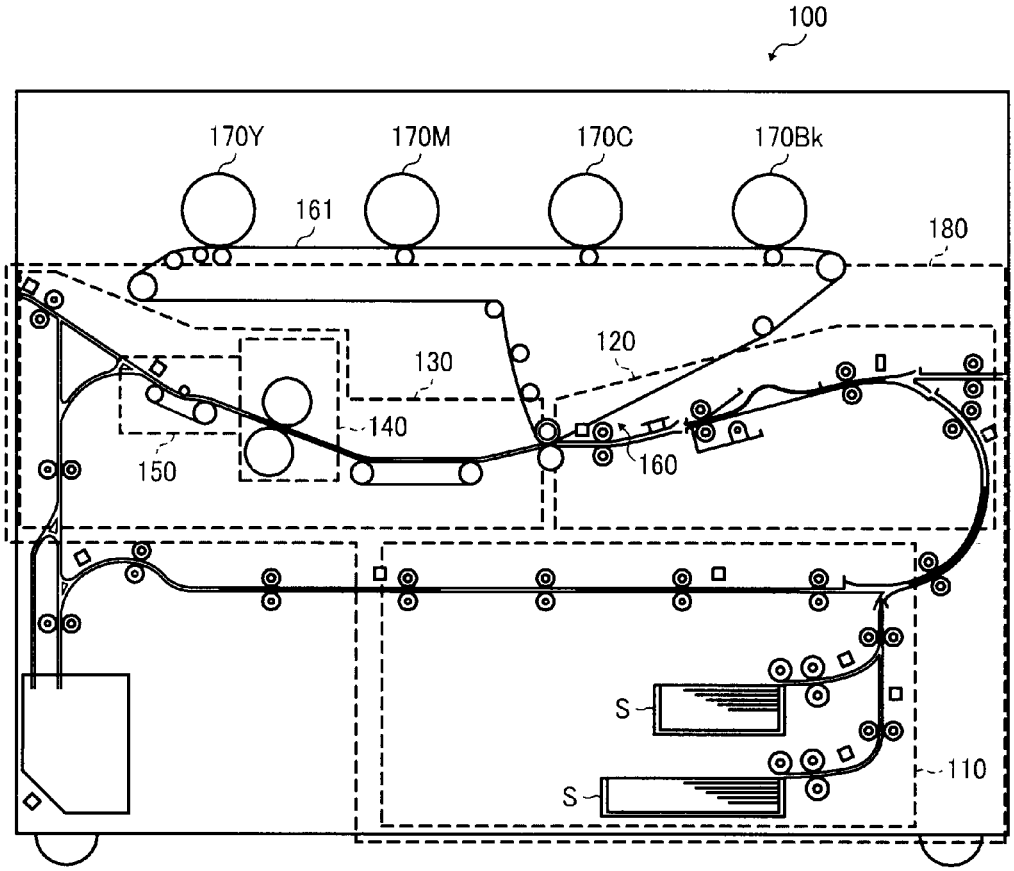
FIG. 6 PRIOR ART
FIG. 6 is a cross-sectional view illustrating a conventional image forming apparatus including a sheet conveyance device.

FIG. 3 is an oblique perspective view of the guide plate 500. As illustrated in FIG. 3, the guide plate 500 includes fastening holes 502 that enable the guide plate 500 to be connected to lateral side plates of the duplex-sheet discharge unit 130. In addition, a curved edge portion 501 is provided so that the sheet S is guided to a vicinity of the upstream guide plate 270 when the guide plate 500 is installed (as shown in FIG. 1).

Next, operation of the sheet conveyance device 150 according to an embodiment of the present invention will now be described. As illustrated in FIG. 1, when the sheet S is conveyed properly, the sheet S is conveyed from a position between the driven roller 220 and the opposing roller 260 to a position between the upper guide plate 291 and the lower guide plate 292, to finally enter the conveyance path S1. Sheet sensors 450, 460 are disposed at the upper guide plate 271 of the upstream guide plate 270 and the upper guide plate 291 of the downstream guide member 290, respectively. It is determined that a paper jam occurs whenever the upstream sheet sensor 450 detects passage of the leading edge of the sheet S but the downstream sheet sensor 460 does not detect the leading edge of the sheet S after a predetermined period of time has elapsed after the detection of the leading edge of the sheet S by the upstream sheet sensor 450 or the downstream sheet sensor 460 does not detect passage of the trailing edge of the sheet S at all.

If the leading edge of the sheet S is curled downward, the sheet S tends to enter the gap D between the driven roller 220 and the lower guide plate 292. Specifically, the sheet S is accompanied by a rotation of the driven roller 20, is deviated from the normal conveyance path S1, and enters inside the apparatus S2. Then, when the sheet sensor 460 does not detect a leading edge of the sheet S, it is determined that a sheet jam occurs, and conveyance of the sheet S is stopped. At this time, the sheet S stops between the conveyance belt 230 and the guide plate 500.

As illustrated in FIG. 2, the driven roller 220 includes a knob 221 disposed at one end thereof. When the jammed sheet S is to be removed, the knob 221 is rotated to guide the sheet S toward an inlet S3 of the sheet conveyance device 150 via the conveyance path formed by the guide plate 500. The sheet S is introduced again to the predetermined conveyance path. Then, the upper guide plate 271 is opened so that the sheet S can be taken out, thus facilitating removal of the jammed sheet.

As described above, the sheet conveyance device 150 according to an embodiment of the present invention is capable of enabling the jammed sheet to be removed easily at the inlet S3 of the sheet conveyance device 150 even when the sheet S enters the gap between the driven roller 220 and the lower guide plate 292.

Further, as can be appreciated by those skilled in the art, the guide plate 500 according to the present embodiment can be adapted to the sheet conveyance device of a conventional image forming apparatus. By installing the present guide plate 500 in a currently available sheet conveyance device, the problem of paper jams may be easily solved.

Figure 7:
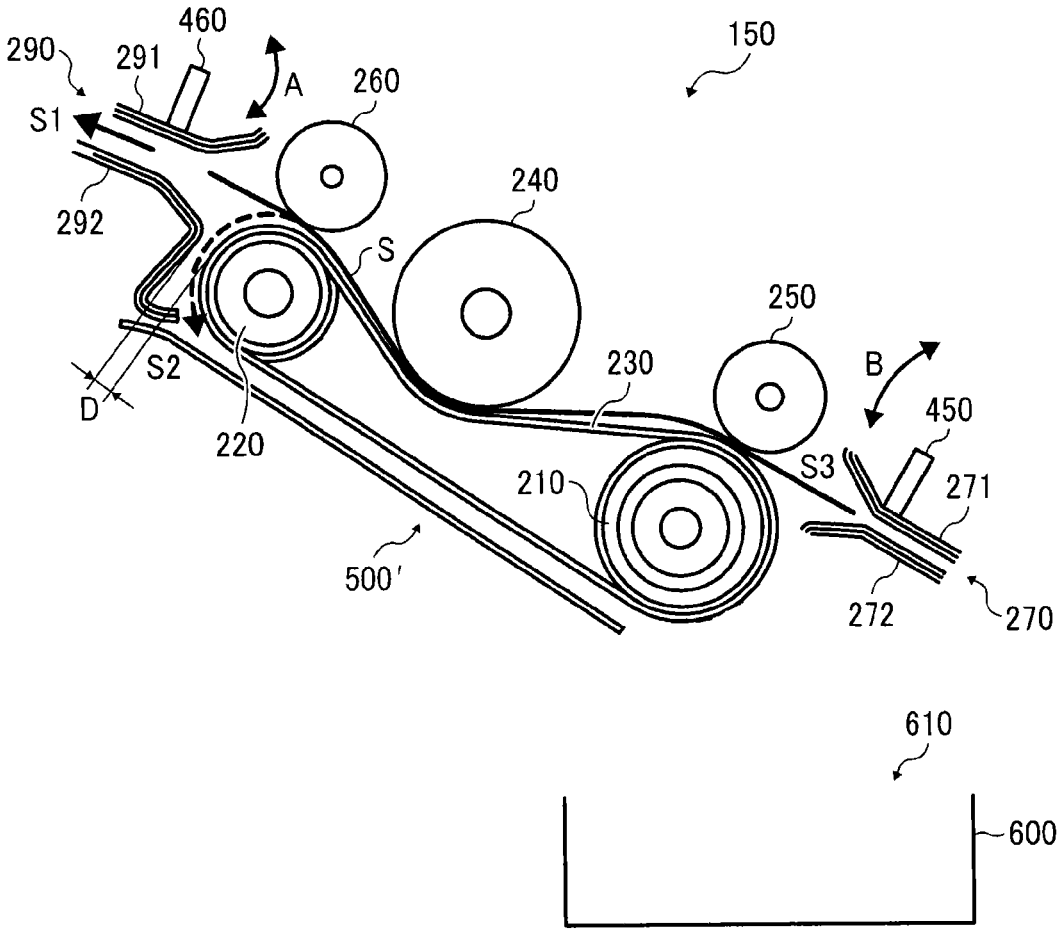
FIG. 7 is a cross-sectional view illustrating a conventional image forming apparatus including a sheet conveyance device.

Further, as illustrated in FIG. 7, a removed-sheet container 600 can be provided at a lower side of a guide plate 500' so that an operator can remove the jammed sheet, thus obviating the need for the curved edge portion 501. In such a configuration of the guide plate 500', because the sheet S is introduced to the removed-sheet container 600, the removal of the sheet S may be performed easily as well. The removed-sheet container 600, herein conceptually shown, includes an opening 610 used as a receiving section. So long as the opening 601 is used as a receiving section, the shape and structure of the removed-sheet container 600 are not limited to the illustrated example.

Additional modifications and variations of the present invention are possible in light of the above teachings. It is therefore to be understood that, within the scope of the appended claims, the invention may be practiced other than as specifically described herein.

What is claimed is:

1. A sheet conveyance device comprising:

an upstream rotary member and a downstream rotary member;

an endless rotatable conveyance belt, stretched over the upstream rotary member and the downstream rotary member, to convey a sheet of recording media thereon in a predetermined conveyance direction;

a conveyance guide including an upper guide plate and a lower guide plate disposed downstream of the conveyance belt in the predetermined conveyance direction and across a gap from the conveyance belt, to guide the sheet between the upper guide plate and the lower guide plate to a predetermined conveyance position; and a guide member adjacent to the lower guide plate of the conveyance guide to guide the sheet from the gap between the conveyance belt and the conveyance guide and onto the conveyance belt, so that the sheet is conveyed from the downstream rotary member to the upstream rotary member, wherein the lower guide plate is below the upper guide plate between the upper guide plate and an end of the guide member that is below the lower guide plate, wherein the guide member includes a straight portion that extends in a direction opposite to the predetermined conveyance direction and parallel to a lower side of the endless rotatable conveyance belt from the end of the guide member to a location at least between the downstream rotary member and the upstream rotary member, wherein the gap extends between the lower guide plate and the conveyance belt, and wherein the end of the guide member is angled in a direction away from the lower guide plate and the end of the guide member extends across the gap below the lower guide plate in the predetermined conveyance direction.

2. The sheet conveyance device as claimed in claim 1, wherein the guide member that introduces the sheet onto the conveyance belt is configured to guide the sheet from the downstream rotary member to the upstream rotary member and further guide the sheet from the upstream rotary member to the downstream rotary member.

3. The sheet conveyance device as claimed in claim 1, further comprising a removed-sheet container disposed opposite the conveyance belt that includes a sheet receiving section.

4. The sheet conveyance device as claimed in claim 1, wherein the guide member has a curved edge portion along one longitudinal side thereof.

5. The sheet conveyance device as claimed in claim 1, wherein the conveyance belt is a single member.

6. An image forming apparatus comprising:

an image forming section; and the sheet conveyance device as claimed in claim 1.

7. The sheet conveyance device as claimed in claim 1, wherein the end of the guide member overlaps a portion of the lower guide plate along the predetermined conveyance direction.

* * * * *